United States Patent [19]

Ezell et al.

[11] Patent Number: 4,823,552

[45] Date of Patent: Apr. 25, 1989

[54] FAILSAFE ELECTROHYDRAULIC CONTROL SYSTEM FOR VARIABLE DISPLACEMENT PUMP

[75] Inventors: Larry O. Ezell, Clinton; John Schmid; Peter Tovey, both of Jackson, all of Miss.

[73] Assignee: Vickers, Incorporated, Troy, Mich.

[21] Appl. No.: 43,829

[22] Filed: Apr. 29, 1987

[51] Int. Cl.[4] ..... F16H 39/46; F04B 49/06; G01L 3/10; G01F 1/00

[52] U.S. Cl. ..... 60/443; 60/445; 60/449; 60/451; 60/452; 417/218; 73/861.53; 73/862.34

[58] Field of Search ..... 60/443, 444, 449, 451, 60/452, 462, 465; 417/220, 218; 73/861.55, 861.53, 861.58, 862.34; 364/138, 139, 175; 91/28-29, 32, 445, 448

[56] References Cited

U.S. PATENT DOCUMENTS

| | | | |
|---|---|---|---|
| 2,889,780 | 6/1959 | Binford | 73/861.53 X |
| 2,999,482 | 9/1961 | Bower | 91/6 X |
| 3,545,265 | 12/1970 | McIlraith et al. | 73/862.34 |
| 4,199,942 | 4/1980 | Kasper | 60/452 X |
| 4,293,284 | 10/1981 | Carlson et al. | 417/218 |
| 4,297,899 | 11/1981 | Blaney et al. | 73/861.58 |
| 4,335,867 | 6/1982 | Bihlmaier | 91/6 X |
| 4,347,748 | 9/1982 | Pierson | 73/862.34 |
| 4,401,009 | 8/1983 | Zeuner et al. | 60/452 X |
| 4,432,703 | 2/1984 | Beutler et al. | 417/218 X |
| 4,459,860 | 7/1984 | Walters | 73/861.55 |
| 4,496,289 | 1/1985 | Heiser et al. | 60/452 X |
| 4,502,109 | 2/1985 | Delmedge et al. | 364/149 X |
| 4,510,750 | 4/1985 | Izumi et al. | 60/443 |
| 4,520,674 | 6/1985 | Canada et al. | 73/660 |
| 4,520,681 | 6/1985 | Moore et al. | 73/862.34 X |
| 4,525,068 | 6/1985 | Mannava et al. | 73/862.34 X |
| 4,561,250 | 12/1985 | Aoyagi et al. | 60/444 X |
| 4,581,699 | 4/1986 | Delmedge et al. | 364/149 X |
| 4,586,330 | 5/1986 | Watanabe et al. | 60/465 X |
| 4,590,806 | 5/1986 | Lutton et al. | 73/862.34 |
| 4,602,515 | 7/1986 | Eichenlaub | 73/862.34 |
| 4,651,045 | 3/1987 | Wagner | 244/78 X |
| 4,655,689 | 4/1987 | Westveer et al. | 60/449 X |
| 4,683,746 | 8/1987 | Cullingford et al. | 73/862.34 X |
| 4,685,063 | 8/1987 | Weihrich et al. | 364/472 |
| 4,714,005 | 12/1987 | Leemhuis | 137/624.11 X |

FOREIGN PATENT DOCUMENTS

| | | | |
|---|---|---|---|
| 31052 | 12/1969 | Japan | 73/861.58 |
| 48204 | 4/1982 | Japan | 60/452 |

OTHER PUBLICATIONS

Yeaple, F. *Fluid Power Design Handbook*, New York, New York: Marcel Dekker, Inc. (1984), p. 124.

*Primary Examiner*—Robert E. Garrett
*Assistant Examiner*—George Kapsalas
*Attorney, Agent, or Firm*—Barnes, Kisselle, Raisch, Choate, Whittemore & Hulbert

[57] ABSTRACT

An electrohydraulic system for control of a variable output pump includes a microprocessor-based controller receiving inputs from condition sensors coupled to the pump and command inputs from a remote master controller. The controller supplies outputs to an electrohydraulic valve for metering hydraulic fluid to a pump control port and thereby controlling pump operation in any one of a number of preselected and prestored pump control modes. A hydromechanical valve is connected in parallel with the electrohydraulic valve for controlling pump operation in the event of electrical malfunction or failure. Circuitry connected between the pump condition sensors and the control computer prevents aliasing errors due to mismatch between the computer sampling frequency and pump speed. A pump torque sensor measures pump input shaft torque.

20 Claims, 5 Drawing Sheets

FAILSAFE ELECTROHYDRAULIC CONTROL SYSTEM FOR VARIABLE DISPLACEMENT PUMP

BACKGROUND OF THE INVENTION

1. Field of the invention

The present invention relates to electrohydraulic control systems, and more particularly to electrohydraulic control of a variable output pump such as a variable displacement pump.

2. Description of the prior art

In electrohydraulic control systems for aircraft or the like, a variable output pump such as a variable displacement pump is coupled through control valves and actuators or motors to operate aircraft mechanisms, such as the landing gear, etc. The pump may comprise a hydraulically controlled pump coupled by an electrohydraulic servo valve to an electronic pump controller which receives command signals from a remote or master controller responsive to the aircraft pilot for controlling the pump flow to the various loads as required for aircraft operation. One or more sensors are coupled to the pump for sensing operation and providing feedback signals to the pump controller, such that the controller effectively closes a servo loop for operation of the pump.

SUMMARY OF THE INVENTION

An object of the present invention is to provide an electrohydraulic control system of the described character which possesses enhanced versatility and accuracy, both in terms of response stability and response time, than do control systems of a similar nature in the prior art, which exhibits an enhanced operating range, which is inexpensive and reliable in long term operation, and/or which is capable of self-diagnostics for identification of potential system failures. Another object of the present invention is to provide an electrohydraulic control system of the described character which finds particular utility in aircraft applications, which possesses reduced size as compared with prior art systems, which features fail-safe operation, and/or which reduces power dissipation and heat loss.

In accordance with a first important aspect of the present invention, an electrohydraulic fluid control system includes a pump for providing a source of hydraulic fluid under pressure and having a pump displacement control port responsive to hydraulic fluid at metered or pilot pressure for controlling pump output. An electrohydraulic valve has fluid ports coupled between the pump output and the displacement-control input, and a valve control input responsive to electronic valve control signals for metering fluid from the pump output to the control input. A hydromechanical valve has a control input port coupled to the pump output, and primary fluid ports connected between the pump output and the pump control input in parallel with the electrohydraulic valve for metering fluid to the pump control input as a function of pump output pressure. Thus, fluid pressure at the pump control input is controlled by the electrohydraulic valve and hydromechanical valve independently.

In one embodiment of the invention, a solenoid valve receives control signals from valve control electronics for selectively connecting either the electrohydraulic valve or the hydromechanical valve to the pump control input port. The solenoid valve is so constructed that the hydromechanical valve is automatically connected to the pump control input port for providing fail-safe operation in the event of electrical power or controller failure. In another embodiment of the invention, a dual-piston actuator at the pump control input port includes a first cylinder/piston cavity for receiving fluid under pressure from the hydromechanical controller and a second cylinder/piston cavity formed within the first piston for receiving fluid at the metered pressure from the electrohydraulic valve. A second hydromechanical valve is connected between the electrohydraulic valve and the dual-piston actuator for venting the second cylinder/piston cavity in the event of electrical failure, whereby operation proceeds under control of the first hydromechanical valve. In a third embodiment, the hydromechanical valve includes a valve spool positionable within a valve housing for variably coupling an input port connected to the pump output to an output port connected to the pump control input port. The electrohydraulic valve includes a piston variably positionable within the valve housing coaxially with the spool and having a finger projecting from the piston for abutting engagement with the spool in opposition to a spool-biasing spring. A valve is coupled to the control electronics for selectively varying pressure differential across the piston and thereby varying force of the piston against the valve spool.

In accordance with another important aspect of the present invention, the pump controller comprises microprocessor-based electronics with internal programming for controlling pump operation in any one of a number of remotely-selectable pump control modes. The pump controller further includes internal memory for storing pump condition signals received from various pump sensors during operation for later analysis as required to diagnose pump health and/or system failure. The pump control electronics includes an I/O port for connection to a maintenance terminal or the like for selectively reading such operating condition signals and/or initiating a pump test mode of operation when the pump system is otherwise in standby. Most preferably, the pump control system includes a solenoid valve or the like for selectively isolating the pump output from the various system loads, such that the pump may be operated and pump conditions sensed as required for various pump diagnostic routines. Most preferably, the pump condition sensors include pressure, flow, speed, displacement and temperature sensors for monitoring a variety of pump operating conditions both during normal operation and during the pump diagnostic mode of operation.

In accordance with yet another aspect of the invention, at least some of the pump condition sensors, such as the pump pressure sensors, are coupled to the microprocessor-based pump controller through an antialiasing filter for reducing error due to mismatch between the controller signal-sampling frequency and the frequency characteristics of the sensor signal. Most preferably, the anti-aliasing filter includes a lowpass filter connected between the sensor and the controller sampling input, and a highpass filter which bypasses the controller. The lowpass and highpass filters have complementary frequency characteristics, and preferably both possess a cutoff frequency about one quarter of the sampling frequency of the controller. Signal gain through the highpass filter network is matched to that through the lowpass filter/controller combination. The combination of lowpass and highpass filters reduces aliasing error without introducing undesirable phase lag.

Other aspects of the invention contemplate specific preferred constructions for pump displacement, torque and flow sensors. More specifically, the pump displacement sensor in the preferred embodiment of the invention comprises a resolver mechanically coupled to the pump yoke and receiving a periodic electrical input signal for providing sine and cosine output signals having relative amplitudes indicative of resolver and yoke position. To reduce aliasing error between resolver electrical input frequency and pump operating speed and their harmonics, the frequency of the resolver input signal is varied as a function of pump speed. A torque sensor in accordance with a presently preferred embodiment of the invention comprises a pair of velocity sensors spaced from each other along the pump drive shaft. The respective velocity sensors supply periodic signals having frequencies which vary as a function of shaft velocity and a phase relationship which varies as a function of torque or twist on the shaft between the sensors. Shaft torque is thus indicated as a function of such phase relationship, and input power is indicated as a function of the product of input torque times pump speed.

A flow sensor in accordance with a preferred embodiment of the invention comprises a sensor body having an inlet port, an outlet port and an internal cavity. A spool is movable within the body for varying cross-section to fluid flow between the inlet and outlet ports and includes a piston positioned within the cavity. Fluid passages respectively couple the inlet and outlet ports to the cavity at opposite sides of the piston, and a spring is positioned within the cavity for assisting fluid pressure from the outlet port against the piston face. Pressure drop between the inlet and outlet ports thus remains virtually constant, and with suitable port shaping the position of the piston and spool varies as a direct function of fluid flow rate. A transducer, such as an LVDT coil magnetically coupled to a ferromagnetic slug carried by the spool, is responsive to spool and piston position within the sensor body for indicating flow rate to the pump controller.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
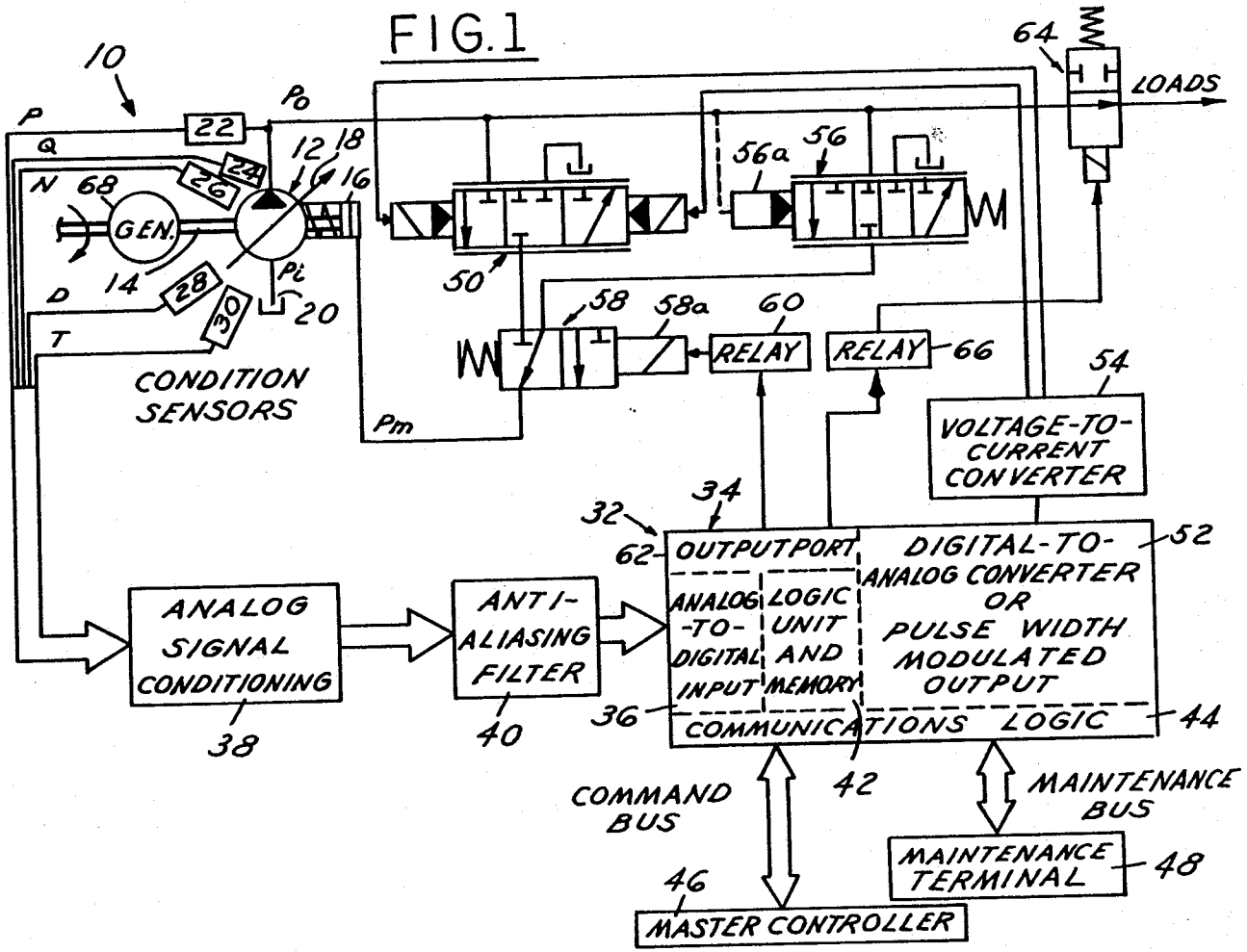
FIG. 1 is a functional block diagram of an electrohydraulic control system in accordance with a presently preferred embodiment of the invention.

FIG. 1 illustrates an electrohydraulic control system 10 for controlling output of a variable displacement pump 12 in accordance with a presently preferred embodiment and application of the invention. Pump 12 is of conventional construction and includes a shaft 14 for coupling to a source of motive power (not shown) such as an airplane engine. An actuator piston 16 receives fluid at metered pressure Pm at a pump control input port for controlling position of the pump yoke 18, and thereby controlling pump displacement and output from sump 20 at elevated pressure Po to a plurality of loads (not shown). A plurality of sensors are coupled to pump 12 for providing corresponding signals indicative of pump operating conditions. Preferably, such pump condition sensors include pressure sensors 22 for providing signals P indicative of pump inlet, outlet and case pressures, flow sensors 24 for providing signals Q indicative of pump case and output flows, speed sensors 26 for providing signals N indicative of speed of rotation of shaft 14 and thus indicative of pump speed, displacement sensors 28 for providing a signal D indicative of angle of pump yoke 18 and thus indicative of pump displacement, and temperature sensors 30 for providing signals T indicative of pump inlet, outlet and case temperatures.

A pump controller 32 includes a microprocessor-based control computer 34 having an analog-to-digital input network 36 for receiving the pump condition signals from sensors 22–30 through analog signal conditioning circuitry 38 and an anti-aliasing filter 40. Control computer 34 includes suitable microprocessor-based control logic units and internal memory 42 for storing control information and for providing pump control signals as a combined function of the condition signals from pump sensors 22–30 and command signals received through communications logic 44 from a remote vehicle or master controller 46. Most preferably, algorithms and parameters for controlling pump operation in a plurality of remotely selectable control modes, such as constant-pressure, constant-flow and/or constant-power pump control modes, are prestored in memory 42. Likewise, logic and memory unit 42 includes facility for sampling and storing the various pump sensor signals during operation for later readout and analysis. Computer communications logic 44 also includes an I/O port, preferably in a serial I/O port, for selective connection to a separate maintenance terminal 48.

An electrohydraulic servovalve 50 receives electronic valve control signals from a digital-to-analog or pulse-width- modulated output 52 of computer 34 through a voltage-to-current converter 54. A hydromechanical control valve 56 has a control or pilot port **56*a* coupled to the output of pump 12. Valves 50,56 have primary fluid-conducting ports controlled by associated inputs and selectively connected through a solenoid valve 58 for providing metered pressure Pm to the pump control input port and piston 16. The solenoid 58***a* of valve 58 is controlled by a relay 60 which receives relay control signals from an associated output port 62 of control computer 34. A second solenoid valve 64 is controlled by a relay 66 which receives signals from output port 62 for selectively disconnecting pump 12 and valves 50,56,58 from the external loads. A generator 68 is coupled to pump input shaft 14 for generating electrical power to power operation of the control electronics.

U.S. Pat. Nos. 4,502,109 (V-3771) and 4,581,699 (V-3771C) disclose electronics, including analog-to-digital converter 36 and digital-to-analog converter 52, suitable for use as control computer 34. U.S. Pat. No. 4,744,218 (V-3939) discloses a hydraulic fluid control system which includes a microprocessor-based pump controller coupled by a command bus to and controlled by a remote master controller for operating the pump in a plurality of selectable control modes. U.S. Pat. Nos. 4,741,159 (V-3818) and 4,714,005 (V-3987) disclose microprocessor-based pump controllers which feature additional selectable control modes. All of such patents and patent applications are assigned to the assignee hereof, and are incorporated by reference for background.

In overall operation of the embodiment of the invention illustrated in FIG. 1, solenoid valve 58, which is illustrated in the de-energized condition in FIG. 1, is energized by relay 60 and computer 34, and operation of pump 12 is controlled by electrohydraulic valve 50 and computer 34 as a combined function of command signals from master controller 46 and the pump condition sensor feedback signals. In the event of abnormal operation as indicated by one or more pump condition signals, computer 34 may de-energize relay 60 so that pump operation is controlled by hydromechanical valve 56. (Pump diagnostic programming runs in background to normal control programming.) Thus, in aircraft applications for example spring pressure of hydromechanical valve 56 may be adjusted to permit minimum operation of pump 12 so that the aircraft can fly and land under emergency conditions. Likewise, in the event of electrical failure and consequent failure of electronically controlled operation, solenoid valve 58 assumes the de-energized condition illustrated in FIG. 1, and control of pump 12 continues through hydromechanical valve 56 for emergency operation and landing as described. Thus, the combination of electrohydraulic valve 50, hydromechanical valve 56, solenoid valve 58 and computer 34 illustrated in FIG. 1 provides redundant and fail-safe operation of pump 12 in the event of emergency conditions, while normally providing versatile and enhanced electronic pump control under normal operating conditions.

Provision of multiple pump condition sensors 22–30 in combination with a microprocessor-based control computer 34 having internal memory 42, a blocking valve 64 and an I/O port for connection to a maintenance terminal 48 significantly enhances diagnostic capabilities, both as applied to normal operating conditions and parameters and standby diagnostics. For example, and again referring to preferred application of the system of the invention for aircraft control, the various pump operating conditions at sensors 22–30 are automatically periodically sampled and stored within memory 42 as hereinabove noted for selective downloading to maintenance terminal 48 following completion of a flight. Such operating condition parameters may then be fully analyzed, either automatically by a suitable analysis algorithm or manually by maintenance personnel, to diagnose system health and any system failures. Furthermore, system maintenance may include specific tests implemented from maintenance terminal 48 (rather than master controller 46) during a pump diagnostic mode of operation by energizing valve 64 and thereby blocking the pump output, and thereafter operating the pump while monitoring the pump condition signals. For example, multiplying pump case flow Q by the difference between case and inlet temperatures T gives a measure of pump heat rejection, which can signify a worn pump if excessive. Likewise, other pump condition signals may be compared during the diagnostic mode of operation to corresponding signals for the same pump during a previous maintenance period, or to empirically obtain signal levels, to indicate a need for pump overhaul or replacement.

Yet another important feature of the embodiment of the invention illustrated in FIG. 1 lies in the use of fiber optic cabling for connection between master controller 46 and pump control computer 34. Such fiber optic cabling is substantially immune to electromagnetic interference, radio interference and lightning strikes, and thus provides reliable interference-free communications in a variety of operating environments. Likewise, generation of electrical power at alternator 68 permits continued operation of the pump and associated controller even if central power is lost. These features provide significantly enhanced and more reliable operation, particularly in aircraft applications, and yet more particularly in applications dealing with combat aircraft in which electromagnetic interference and local aircraft damage are significant dangers.

Figure 2:
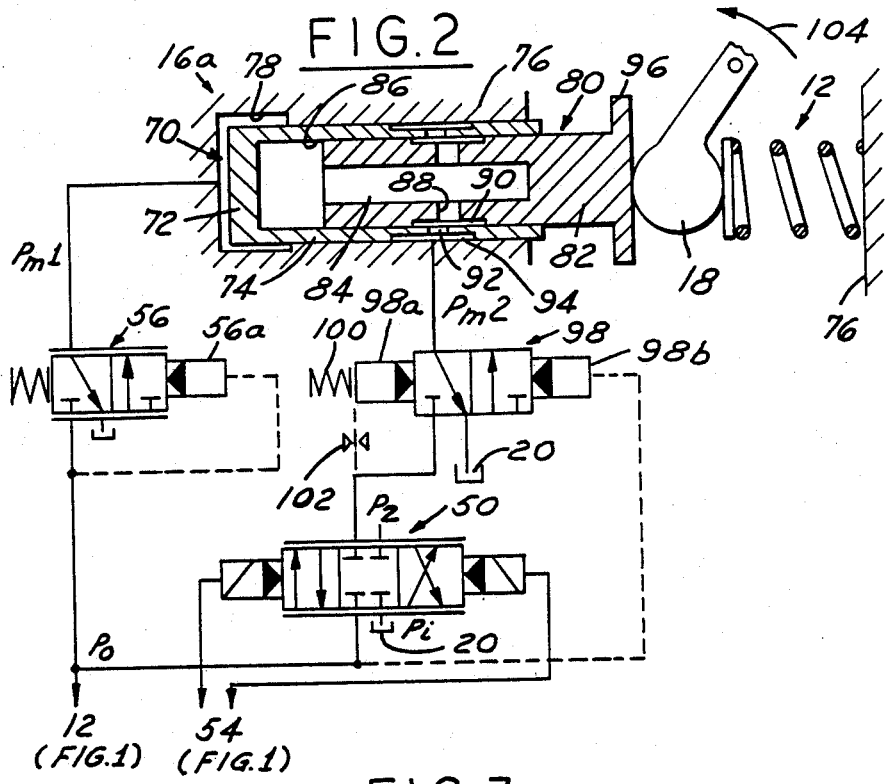
FIG. 2 is a fragmentary block diagram illustrating combined electrohydraulic and hydromechanical control of pump displacement in accordance with a modification to the system of FIG. 1.

FIG. 2 illustrates a modification to the combined electrohydraulic/hydromechanical control feature of the invention. In FIG. 2, and in all subsequent figures, elements identical to those in FIG. 1 are indicated by correspondingly identical reference numerals, and elements which are related but modified are indicated by correspondingly identical reference numerals followed by associated suffixes. In the modification of FIG. 2, pump stroke-control piston 16*a* comprises a dual-piston actuator including a first cup-shaped piston 70 having an end wall 72 and a side wall 74 slidably carried by the pump housing 76. A cavity 78 is formed between closed end 72 of piston 70 and the surrounding pump housing, and has a fluid inlet coupled to hydromechanical valve 56. A second cup-shaped piston 80 has a closed end 82 and a side wall 84 slidably received within side wall 74 of piston 70, with piston end 82 being positioned remotely of piston end 72 so as to form a second cavity 86 therebetween. Cavity 86 communicates through a passage 88 in piston side wall 84 to an annular cavity 90 surrounding the piston side wall. A port 92 in piston side wall 74 registers with cavity 90 and communicates with an annular cavity 94 surrounding side wall 74. It will be noted in FIG. 2 that cavity 86 communicates with cavity 94 throughout the entire range of motions of piston 70,80. A flange 96 extends radially outwardly at the closed end 82 of piston 80 where piston 80 engages yoke 18 of pump 12. An isolation valve 98 has a valve element biased by the spring 100 for normally venting actuator cavity 86 to sump 20. A first pilot port 98*a* on valve 98 is connected through a damping orifice 102 to the output of electrohydraulic valve 50, with fluid pressure through orifice 102 assisting spring 100 and biasing the valve element of valve 98 to the position illustrated in FIG. 2. An opposing pilot port 98*b* of valve 98 is connected to the output of pump 12 for receiving fluid at pressure Po.

In operation, it will be appreciated that dual-piston actuator 16*a* is subject to continuous parallel control by electrohydraulic valve 50 and hydromechanical valve 56, with the dual-piston structure effectively functioning to add the corresponding metered pressures Pm1,Pm2. Hydromechanical control valve 56 is thus continuously active and can automatically override electrohydraulic control at any point without requiring external solenoid activation as in the embodiment of FIG. 1. Valve 98 functions to connect cavity 86 to sump 20 in the event of failure or overpressure at electrohydraulic valve 50. Specifically, during normal operation, pump output pressure Po is greater than metered pressure P2 from valve 50 so that valve 98 is normally in the condition opposite to that of FIG. 2 and valve 50 is normally connected directly to cavity 86 (with pressure Pm2 thus being substantially equal to pressure P2). In the event of loss of pressure at valve 50, i.e., P2=Pi, due to either valve or system failure, the element of valve 98 is urged to the position illustrated in FIG. 2 by spring 100, cavity 86 is vented to sump 20 and operation continues under control of valve 56. The open end of piston 70 engages flange 96 on piston 80 for direct de-stroking of pump yoke 18 in the direction 104. In the event that valve 50 fails in a mode which connects pump output at pressure Po to valve 98, i.e., P2=Po, such pump output pressure through delay or damping orifice 102 and in combination with spring 100 urges valve 98 to the position illustrated in FIG. 2, whereby valve 50 is effectively isolated and operation proceeds under control of valve 56 as previously described. Thus, the combined electrohydraulic/hydromechanical valve control arrangement of FIG. 2 provides smooth switching between electrohydraulic and hydromechanical control operation without external diagnosis or intervention. Furthermore, dual piston actuator 16*a* eliminates any need for separate actuators, thus reducing pump weight and cost.

Figure 3:
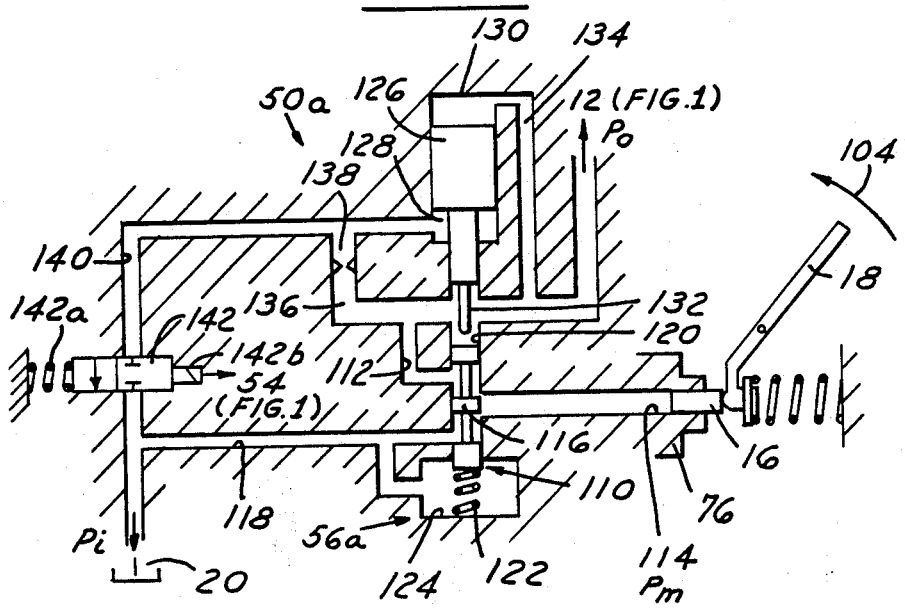
FIG. 3 is a fragmentary block diagram which illustrates combined electrohydraulic and hydromechanical pump control in accordance with another modification to the embodiment of FIG. 1.

FIG. 3 illustrates another modified electrohydraulic/hydromechanical control construction. In the embodiment of FIG. 3, hydromechanical valve 56*a* comprises a spool 110 having spaced lands captured for axial sliding motion within a housing, preferably pump housing 76. A passage 112 provides primary fluid inlet to valve 56*a*, and a passage 114 provides fluid outlet to pump control piston 16, with passage of fluid from inlet 112 to outlet 114 being past the spool land 116 and thus controlled by position of spool 110 within housing 76. Outlet passage 114 is also connected past land 116 to drain passage 118 and thence to sump 20. The control port 120 of valve 56*a* provides access to the pump output at pressure Po onto spool 110 against the opposing force of a coil spring 122 which engages spool 110 within the housing cavity 124. Spool 110 thus controls application of pump output pressure at inlet 112 to piston 16 through passage 114, and/or from passage 114 to sump 20 through passage 118, as a function of pump outlet pressure Po as on one end of spool 110 compared with pressure of spring 122 on the opposing spool end. As pump output pressure increases and exceeds the force applied by spring 122, land 116 affords additional communication between passages 112,114, and thus exerts pressure on yoke 18 through piston 16 to de-stroke yoke 18 in the direction 104.

Electrohydraulic valve 50*a* in the embodiment of FIG. 3 comprises a piston 126 positioned within a housing, preferably pump housing 76, for sliding motion coaxially with spool 110. Piston 126 and housing 76 form a first cavity 128 adjacent to spool 110 and a second cavity 130 on a side of piston 126 remote from spool 110. A finger 132 extends from piston 126 coaxially therewith into control passage 120 of hydromechanical valve 56*a* for abutment with spool 110 against the force of spring 122. A passage 134 in housing 76 feeds fluid at pump outlet pressure Po to cavity 130. A second passage 136 feeds fluid at pump outlet pressure Po through a damping orifice 138 to cavity 128. Cavity 128 also communicates through a passage 140 and a valve 142 with sump 20. Valve 142 is configured normally to block passage of fluid under control of valve spring 142*a*, and to selectively connect cavity 128 to sump 20 when control computer 34 (FIG. 1) energizes valve coil 142*b*. Valve 142 may comprise a proportional valve or a pulse width modulated solenoid valve.

In operation, position of spool 110 within hydromechanical valve 56*a* is controlled not only directly by pump outlet pressure at port 120 as previously described, but also by abutment force of piston 126 through finger 132. That is, pump outlet pressure Po within cavity 130 is normally balanced on piston 126 by pressure within cavity 128 through orifice 138. However, selective energization of valve 142 effectively bleeds fluid pressure from cavity 128, so that pressure within cavity 130 exceeds that in cavity 128 and piston 126 is urged by the pressure differential thereacross against spool 110. As the combined pressure on spool 110 increases, due to pump outlet pressure Po acting directly on spool 110 and through piston 126, increased fluid is fed past land 116 into passage 114 so as to de-stroke the pump in the direction 104. Piston 126 has an area several times that of spool 110, so that only a small differential pressure across piston 126 overcomes the force of spring 122. As current to valve 142 is reduced, pressure within cavity 128 increases and force applied to spool 110 by piston 126 correspondingly decreases. Pump stroke is thus stabilized or increased. It will be noted that hydromechanical valve 56*a* and spool 110 are at all times free to respond to increased pump output pressure independently of electrohydraulic valve 50*a*. Thus, in the event of electrical failure, piston 126 becomes hydrostatically balanced and pump operation continues under control of hydromechanical valve 56*a*. It will also be noted that the embodiment of the invention illustrated in FIG. 3 replaces the usual two-stage hydromechanical pressure compensator and electrohydraulic valve with a single assembly. A single-stage electronic valve 142 is used in place of the more expensive two-stage valve 50 in the embodiments of FIGS. 1 and 2.

A problem which inheres in use of digital electronics, including microprocessor-based control computer 34 (FIG. 1), in closed loop control of hydraulic action, including pump control, lies in so-called aliasing, which is an error created by mismatch between the sampling frequency of the digital electronics and the frequency of the sampled signal. This problem is particularly acute, for example, in closed loop control in which pump output pressure Po is sensed because of a ripple in pump pressure related to pump speed and other factors. Aliasing error will occur if the sampling frequency of the computer is less than twice the frequency of the sampled signal. Of course, it is undesirable to employ a high sampling frequency because this would require inordinate microprocessor time which could otherwise be employed for control purposes.

Figure 4:
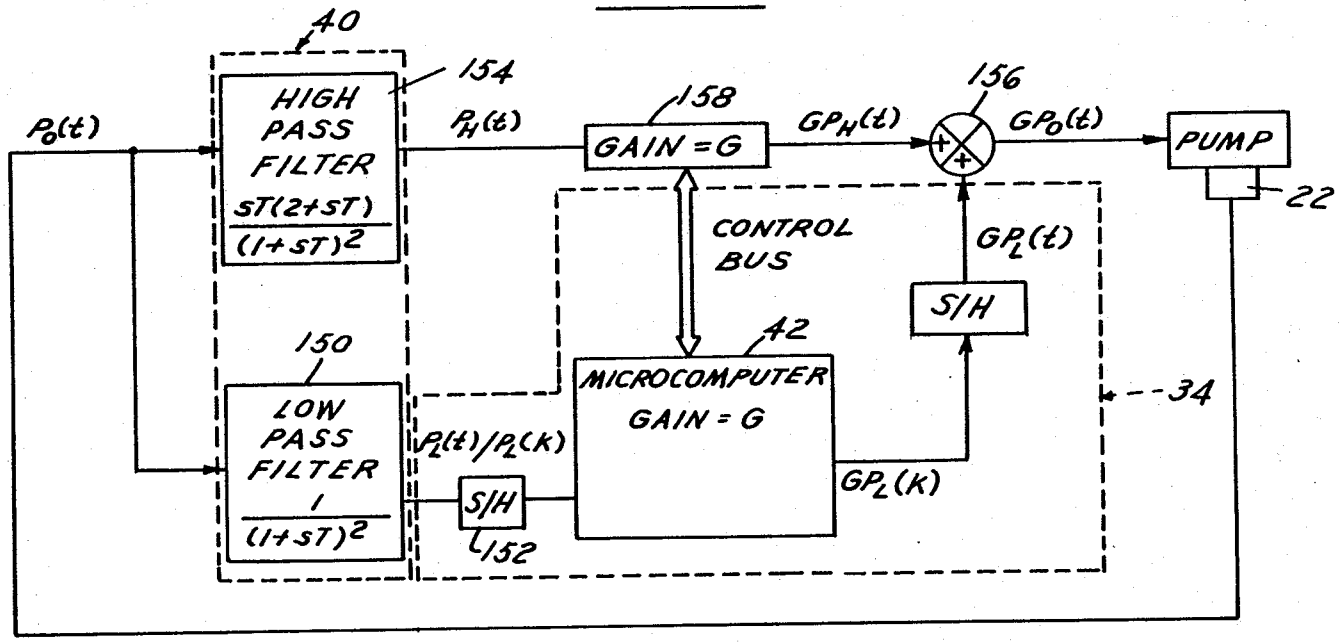
FIG. 4 is a functional block diagram of the anti-aliasing filter illustrated in FIG. 1.
Figure 5A:
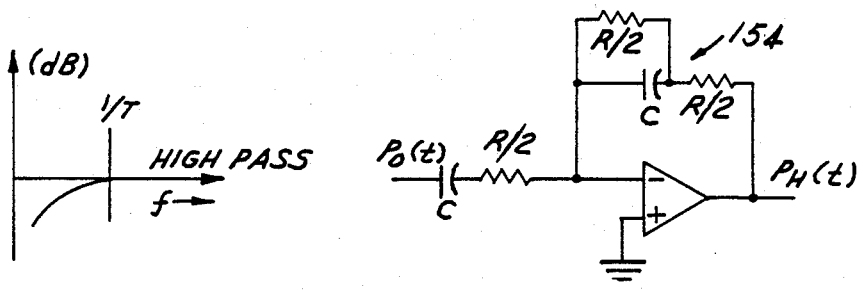
FIGS. 5A and 5B are electrical schematic drawings, with accompanying frequency characteristic curves, of analog equivalents to the highpass and lowpass filters illustrated in FIG. 4.
Figure 5B:
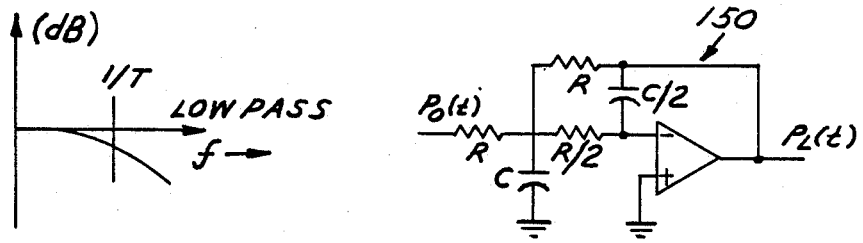

In accordance with another important aspect of the present invention, the problem of aliasing error is addressed by providing an anti-aliasing filter 40 (FIGS. 1 and 4) between pump sensors 22–30 and control computer 34. In particular, anti-aliasing filter 40 includes a lowpass filter 150 between pressure sensor 22, for example, and the sample-and-hold input 152 of microcomputer 34. Lowpass filter 150 in a presently preferred embodiment of the invention comprises a binomial second order filter having the filter characteristic $1/(1+sT)^2$, where s is the conventional Laplace operator and T is the filter time constant and T is usually four times the sampling period of the microprocessor 42. Microcomputer logic 42 thus operates upon a sampled pump pressure condition signal $P_L(k)$ in which the effect of ripple has been substantially removed. To compensate for phase lag introduced by lowpass filter 150, with consequent problems of response and stability margins that would otherwise be introduced, filter 40 also includes a highpass filter 154 which receives the pressure signal Po(t) from sensor 22. Highpass filter 154 in the preferred embodiment of the invention likewise comprises a binomial second order filter having frequency characteristics which are complementary to those of lowpass filter 150—i.e., having a frequency response given by the expression $sT(2+sT)/(1+sT)^2$ in FIG. 4. The high frequency output $P_H(t)$ of filter 154 bypasses the logic unit 42 of microcomputer 34 and is fed to a summing junction 156 at which the high frequency pressure sensor signal components are added to the low frequency components on which control operations have been performed. For example, if the microprocessor represents unity gain then the sum of the inputs to junction 156 precisely reconstructs the original signal for all frequencies. Thus, where servo logic unit 42 possesses a gain G, the output of highpass filter 154 must likewise be multiplied by gain G. An amplifier 158 is connected between filter 154 and junction 156, with the gain G of amplifier 158 being controlled by logic unit 42. FIGS. 5A and 5B illustrate the analog highpass filter 154 and lowpass filter 150 respectively, together with corresponding frequency characteristics. In a working embodiment of the invention, with a microcomputer sampling period of 2.5 ms, T is equal to 10 ms and provides satisfactory results.

Figure 6:
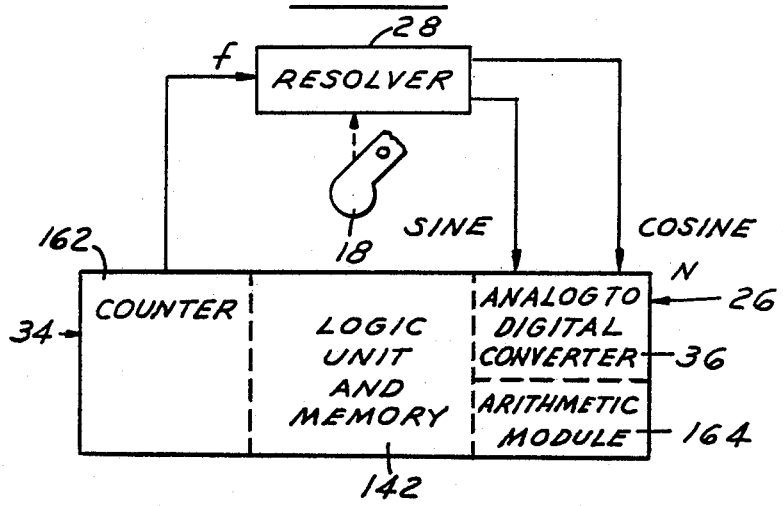
FIG. 6 is a functional block diagram which illustrates connection of the pump displacement sensor in FIG. 1 to the pump control electronics.

Aliasing is likewise a problem with sensor 28 (FIGS. 1 and 6) which is responsive to angle of pump yoke 18 for providing a corresponding pump displacement signal D to the control electronics. Temperature stability is also a problem in many conventional pump displacement sensor constructions. The problems of aliasing and temperature stability are addressed and substantially overcome by the displacement sensor configuration 160 illustrated in FIG. 6. In particular, displacement sensor 28 comprises a conventional resolver which is mechanically coupled to yoke 18. Resolver 28 receives a periodic electrical input signal, as from a counter 162 of microcomputer 34 in FIG. 1, and provides corresponding sine and cosine output signals at 90° phase angle and at relative amplitudes which vary as a function of position of yoke 18. Since the amplitudes of both sine and cosine signals vary with temperature, division of such signals within an arithmetic module 164 of microcomputer 34 in FIG. 1 provides an output which varies as a function of the tangent of yoke angle and is substantially independent of temperature. To overcome aliasing in accordance with another important aspect of the invention, the frequency f of the periodic input to resolver 28 is automatically varied as a function of pump speed N. In particular, the output of counter 162 at frequency f is switched by the logic unit 142 of microcomputer 34 in FIG. 1 between frequencies f1 and f2 as a preselected function of pump speed N. For example, in one resolver/pump combination, and at a resolver excitation frequency of 2472 Hz, it was empirically found that harmonic vibrations in yoke 18 caused aliasing errors at pump speeds of 1831, 2194, 2743, 3302, 3430 and 3661 rpm. However, at a resolver excitation frequency of 10 KHz, aliasing occurred at pump speeds of 2220, 2774, 3341 and 3701 rpm. Similar relationships can be readily obtained empirically with other resolver/pump combinations. Thus, using one of the excitation frequencies as the fundamental or standard frequency, excitation is automatically switched to the secondary frequency as pump speed approaches one of the speeds at which aliasing is a problem for the particular pump/resolver combination. Logic unit 142 may include a lookup table in which resolver excitation frequency is stored as a function of pump speed.

Figure 7:
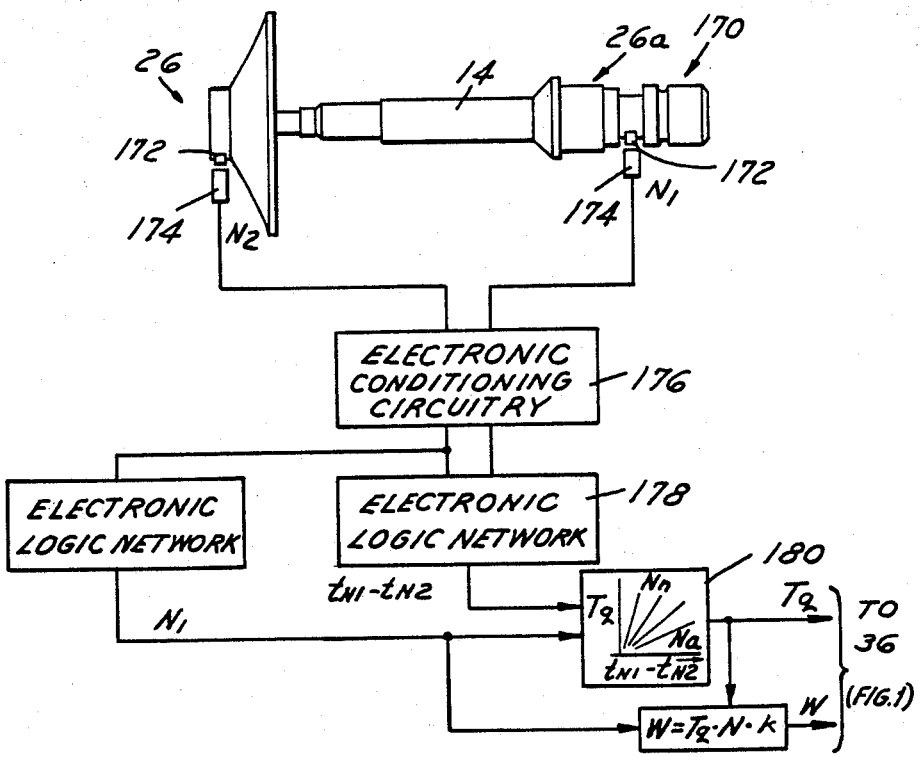
FIG. 7 is functional block diagram which illustrates connection of the pump velocity sensors in FIG. 1 to the pump control electronics.

FIG. 7 illustrates a pump torque sensor 170 in accordance with a presently preferred embodiment of the invention as comprising a pair of pump speed sensors **26,26*a* spaced from each other lengthwise of the pump input shaft 14 (which is shown apart from the pump housing). Each sensor 26,26*a* comprises a section 172 of ferromagnetic material and an electromagnetic pickup 174 positioned so as to be responsive to passage of the associated material section 172 to generate a corresponding pulse. The outputs N2 and N1 from speed sensors 26,26*a* thus comprise pulsed periodic signals having identical frequencies corresponding to the speed of rotation of shaft 14. The variation in the phase relationship between the periodic outputs N2,N1 due to torque or twist on shaft 14 is employed to indicate pump input torque. Thus, the outputs N2,N1 are fed through conditioning circuitry 176 responsive to the leading edges of the respective trained pulses, for example, and to a logic network 178 for indicating phase relationship therebetween as a function of the separation in time between the respective pulsed signals—i.e., t(N1)−t(N2). The output of network 178, together with a signal indicative of shaft speed—e.g., signal N1—is fed to circuitry such as a lookup table 180** having prestored therein data relating input torque Tq to phase relationship t(N1)−t(N2) as differing predetermined functions of pump speed N. Input torque Tq so obtained is employed to determine input power W as a function of the product Tq*N*k, where k is a constant. The signals Tq and W so obtained may be used during normal operation, for example, for implementing a constant-torque control mode of operation at pump 12, for measuring and periodically storing pump torque and input power in memory 42 (FIG. 1) for later diagnosis, and during a diagnostic mode of operation to measure rejected power by dividing input power W by pump yoke angle (indicated at displacement D) multiplied by pump speed N and a differential and pressure Po-Pi between pump output and input.

Figure 8:
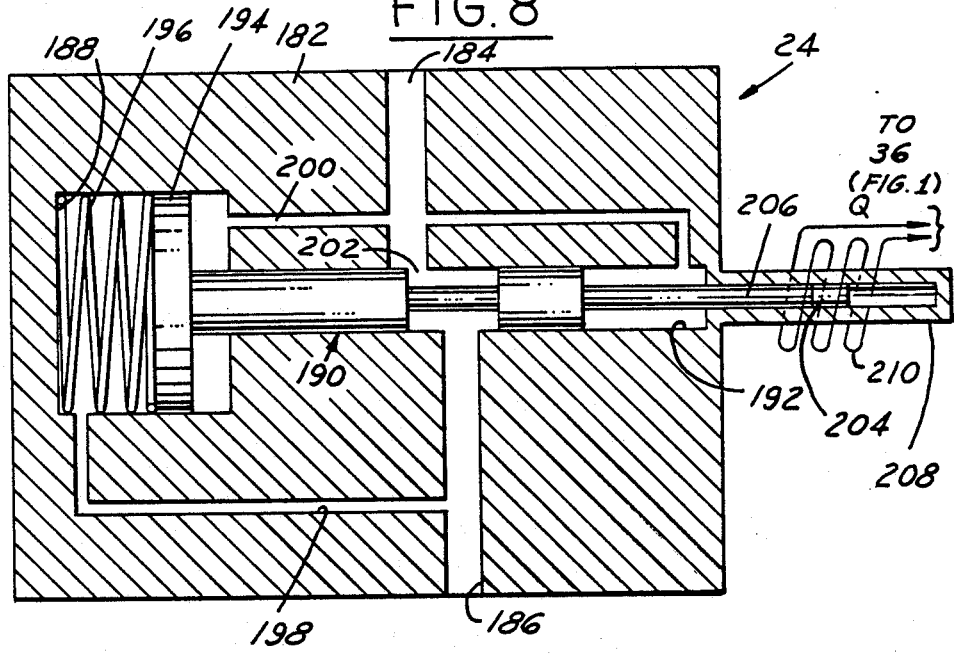
FIG. 8 is a schematic diagram which illustrates a fluid flow sensor in accordance with another aspect of the invention.

FIG. 8 illustrates a presently preferred embodiment of flow sensor 24 as comprising a sensor body 182 having an inlet port 184, an outlet port 186 and an internal cylindrical cavity 188. A spool 190 is slidably captured in a passage 192 which extends from cavity 188 and intersects ports 184,186, such that communication between ports 184,186 varies as a function of position of spool 190 within passage 192. A piston 194 is carried by spool 190 within cavity 188, and a coil spring 196 is captured within cavity 188 and engages piston 194 so as to urge spool 190 toward closure of passage between inlet 184 and outlet 186. A fluid passage 198 couples outlet 186 to cavity 188 on a side of piston 194 so as to urge spool 190 to the flow-closing position, and a passage 200 couples inlet 184 to cavity 188 on the opposing side of piston 194.

In operation, as flow increases and pressure at inlet port 184 correspondingly increases, such pressure on piston 194 within cavity 188 urges spool 190 to the left so as to open passage between inlet 184 and outlet 186. As the orifice 202 so opens where inlet 184 intersects passage 192, inlet pressure falls and the spool settles at a steady-state position at which forces on the opposing sides of piston 194 are balanced. Thus, pressure drop between inlet 184 and outlet 186 is maintained virtually constant provided that the rate of the spring 196 is low. With suitable port 202 shaping then that position of spool 190 and the size of orifice 202 vary as a function of flow volume so as to maintain such virtually constant pressure drop. Most preferably, orifice 202 is a square root law with spool travel, so that spool position to all purposes is a direct linear function of fluid flow.

To sense spool position, a slug or bead 204 of ferromagnetic material is carried on a finger 206 which projects from spool 190 within an extension 208 from body 182. A pair of coils 210 surrounds extension 208 such that coil inductance varies with position of bead 204 within extension 208. The combination of coils 210 and bead 204 thus comprise an LVDT having an output Q coupled to analog signal conditioning circuitry 38 in FIG. 1. The effect of sensor 24 on pump 12 remains constant because of virtually constant pressure drop across the sensor. Furthermore, flow measurement is invariant with fluid viscosity and temperature changes.

We claim:

1. An electrohydraulic fluid control system comprising:

means for providing a source of hydraulic fluid under pressure, means responsive to hydraulic fluid at metered pressure for performing a preselected operation, electrohydraulic proportional valve means having fluid ports coupled between said source and said pressure-responsive means, and a control input responsive to electronic valve control signals for metering fluid from said source to said pressure-responsive means as a proportional function of said valve control signals, hydromechanical proportional valve means having a control input port coupled to said source, and primary fluid ports connected between said source and said pressure-responsive means in parallel with said electrohydraulic valve means for metering fluid to said pressure-responsive means as a proportional function of pressure of fluid at said control port, fluid pressure at said pressure-responsive means being controlled by said electrohydraulic valve means and said hydromechanical valve means independently, and second electrohydraulic two-position valve means responsive to second electronic valve control signals for selectively connecting said fluid ports of one of said electrohydraulic valve and said hydromechanical valve, but not both, to said pressure-responsive means.

2. The system set forth in claim 1 wherein said fluid-providing means comprises a variable output fluid pump, and wherein said pressure-responsive means comprises means for controlling operation of said pump as a function of said metered pressure.

3. The system set forth in claim 1 wherein said second electrohydraulic valve means is constructed to connect said hydromechanical valve means to said pressure responsive means in the event of loss of electrical power.

4. An electrohydraulic control system comprising a variable output pump for coupling to a source of motive power to provide hydraulic fluid under pressure from a fluid source to a hydraulic load, and pump control means for receiving command signals and controlling output of said pump as a predetermined function of said command signals, said pump control means comprising:

a plurality of sensors coupled to said pump for sensing operation conditions at said pump and providing corresponding condition signals, memory means for periodically sampling and storing said condition signals during operation of said pump, means for selectively retrieving condition signals sampled and stored in said memory means for diagnosing condition of said pump as a function of said condition signals, blocking valve means coupled to an output of said pump and responsive to a valve control signal for blocking flow of fluid from said pump to said load, and means for initiating a diagnostic mode of operation, means responsive to said mode-initiating means for generating said valve control signal and blocking flow of fluid to said load, and means responsive to said condition signals during said mode for indicating condition of said pump.

5. The system set forth in claim 4 wherein said pump comprises a variable displacement pump, and wherein said sensors are selected from the group consisting of pump inlet, outlet and case pressure sensors, pump inlet, outlet and case temperature sensors, a pump speed sensor, a pump displacement sensor, pump case and output flow sensors, and a pump input power sensor.

6. An electrohydraulic control system comprising a variable output pump for coupling to a source of motive power to provide hydraulic fluid under pressure from a fluid source to a hydraulic load, and pump control means for receiving command signal and controlling output of said pump as a predetermined function of said command signals, said pump control means comprising microprocessor-based control means including:

a plurality of sensors coupled to said pump for sensing operation conditions at said pump and providing corresponding condition signals, memory means for periodically sampling and storing said condition signals during operation of said pump, and means for selectively retrieving condition signals sampled and stored in said memory means for diagnosing condition of said pump as a function of said condition signals, wherein said pump comprises a variable displacement pump having a yoke and an input shaft, wherein said sensors include a resolver coupled to said yoke and a pump speed sensor coupled to said shaft, and wherein said pump control means includes means for directing a periodic input signal to said resolver such that said resolver provides a pair of periodic output signals as a function of yoke displacement, means for indicating yoke displacement as a function of said signal pair, and means coupled to said signal-providing means and responsive to said speed sensor for automatically varying frequency of said periodic input signal as a function of pump speed.

7. The system set forth in claim 6 wherein said frequency-varying means comprises means for providing said input signal at two distinct frequencies, and means for selecting between said distinct frequencies as a function of pump speed.

8. An electrohydraulic control system comprising a variable output pump for coupling to a source of motive power to provide hydraulic fluid under pressure from a fluid source to a hydraulic load, and pump control means for receiving command signals and controlling output of said pump as a predetermined function of said command signals, said pump control means comprising:

a plurality of sensors coupled to said pump for sensing operation conditions at said pump and providing corresponding condition signals, memory means for periodically sampling and storing said condition signals during operation of said pump, and means for selectively retrieving condition signals sampled and stored in said memory means for diagnosing condition of said pump as a function of said condition signals, wherein said pump includes a power input shaft; wherein said sensors include first and second speed sensors at spaced positions along said shaft for providing respective first and second periodic signals as functions of speed rotation of said shaft; and wherein said pump control means comprises means responsive to a phase relationship between said first and second speed signals for indicating input torque to said pump, including look-up table means having prestored therein data relating input torque to said phase relationship as differing predetermined functions of pump speed.

9. The system set forth in claim 8 wherein said control means includes means for indicating input power to said pump as a function of input torque times pump speed.

10. An electrohydraulic control system comprising a variable displacement pump having a yoke and an input shaft for coupling to a source of motive power, and pump control means coupled to said yoke for controlling output of said pump as a function of yoke position, characterized in that said pump control means includes means for indicating yoke position comprising a resolver having a mechanical input coupled to said yoke, an electrical input for receiving a periodic signal, and a pair of electrical outputs electromagnetically coupled to said electrical input for providing a pair of output signals at predetermined relationship which varies as a function of mechanical input to said resolver, means for directing a said periodic signal to said resolver electrical input, a sensor operatively coupled to said shaft for providing a signal indicative of pump speed, and means for selectively varying frequency of said periodic signal as a predetermined function of pump speed.

11. The system set forth in claim 10 wherein said frequency-varying means comprises means for providing said input signal at two distinct frequencies, and means for selecting between said distinct frequencies as a function of pump speed.

12. An electrohydraulic control system comprising an electrohydraulic device responsive to electronic control signals for performing hydraulic operation, sensor means for sensing operation conditions at said device and providing a corresponding condition signal having a varying frequency characteristics, and microprocessor-based control means including means for receiving command signals, means for sampling said condition signal at predetermined periodic intervals and means for providing said control signals to said device as a combined function of said command signals and said sampled condition signals, characterized in that said control means further includes means for reducing aliasing error between said predetermined periodic intervals and said varying frequency characteristics, said error-reducing means comprising first electronic filter means having an input for receiving said condition signal and an output for feeding low frequency components of said condition signal to said sampling means, said microprocessor-based control means providing first control signals as a combined function of said sampled low frequency components and said command signals, second electronic filter means having an input for receiving said condition signal and an output for providing high frequency components of said condition signal, and means for providing said electronic control signals to said device as a function of said first control signals plus said high frequency components of said condition signal, such that aliasing error is reduced without introducing phase lag between said first control signals and said high frequency components of said condition signals.

13. The system set forth in claim 12 wherein said first and second filter means having complementary frequency characteristics, such that outputs of said first and second filter means together precisely match said input condition signals in both amplitude and phase.

14. The system set forth in claim 13 wherein said first and second filter means have cut-off frequencies corresponding substantially to one quarter of said predetermined periodic intervals.

15. The system set forth in claim 13 wherein said first and second filter means have cutoff frequencies corresponding substantially to one quarter of said predetermined periodic intervals.

16. The system set forth in claim 15 wherein said second filter means and the combination of said first filter means and said microprocessor-based control means have substantially identical gain characteristics.

17. An electrohydraulic control system comprising a variable output pump for coupling to a source of motive power to provide hydraulic fluid under pressure from a fluid source to a hydraulic load, and microprocessor-based pump control means for receiving command signals and controlling output of said pump as a predetermined function of said command signals, said pump control means comprising:

a plurality of sensors coupled to said pump for sensing operation conditions at said pump and providing corresponding condition signals, memory means for periodically sampling and storing said condition signals during operation of said pump, and means for selectively retrieving condition signals sampled and stored in said memory means for diagnosing condition of said pump as a function of said condition signals, wherein at least one of said sensors provides a said condition signal having varying frequency characteristics; wherein said microprocessor-based control means includes means for sampling said condition signal at predetermined periodic intervals and means for providing control signals to said pump as a combined function of said command signals and said sampled condition signals, said control means further including means for reducing aliasing error between said predetermined periodic intervals and said varying frequency characteristics, said error-reducing means comprising first electronic filter means having an input for receiving said condition signal and an output for feeding low frequency component of said condition signal at said sampling means, said microprocessor-based control means providing first control signals as a combined function of said sampled low frequency components and said command signals, second electronic filter means having an input for receiving said condition signal and an output for providing high frequency components of said condition signal, and means for providing said electronic control signals to said pump as a function of said first control signals plus said high frequency components of said condition signal, such that aliasing error is reduced without introducing phase lag between said first control signal and said high frequency components of said condition signals.

18. The system set forth in claim 17 wherein said first and second filter means have complementary frequency characteristics, such that outputs of said first and second filter means together precisely match said input condition signals in both amplitude and phase.

19. The system set forth in claim 18 wherein said second filter means and the combination of said first filter means and said microprocessor-based control means have substantially identical gain characteristics.

20. The system set forth in claim 18 wherein said at least one sensor comprises a pressure sensor.

* * * * *